US005807472A

United States Patent [19]

Hendrix et al.

[11] Patent Number: 5,807,472

[45] Date of Patent: Sep. 15, 1998

[54] PARTING FIXTURE FOR REMOVAL OF A SUBSTRATE FROM A MANDREL

[75] Inventors: Loren E. Hendrix, Webster; William G. Herbert, Williamson; Gary J. Maier; Ernest F. Matyi, both of Webster, all of N.Y.

[73] Assignee: Xerox Corporation, Rochester, N.Y.

[21] Appl. No.: 782,239

[22] Filed: Jan. 13, 1997

[51] Int. Cl.[6] ..... C25D 1/20

[52] U.S. Cl. ..... 205/67; 205/73; 164/213

[58] Field of Search ..... 205/67, 73; 164/213

[56] References Cited

U.S. PATENT DOCUMENTS

| | | | |
|---|---|---|---|
| 3,844,906 | 10/1974 | Bailey et al. | 204/9 |
| 3,927,463 | 12/1975 | Dupree et al. | 204/6 |
| 3,950,839 | 4/1976 | Dupree et al. | 204/6 |
| 3,954,568 | 5/1976 | Dupree | 204/9 |
| 4,067,783 | 1/1978 | Okinaka et al. | 204/43 G |
| 4,501,646 | 2/1985 | Herbert | 204/9 |
| 4,781,799 | 11/1988 | Herbert, Jr. et al. | 204/9 |
| 5,021,109 | 6/1991 | Petropoulos et al. | 156/137 |
| 5,064,509 | 11/1991 | Melnyk et al. | 204/9 |
| 5,254,239 | 10/1993 | Matyi et al. | 205/67 |
| 5,334,155 | 8/1994 | Sobel | 604/110 |
| 5,385,660 | 1/1995 | Herbert et al. | 205/73 |
| 5,389,227 | 2/1995 | Matyi et al. | 205/73 |
| 5,395,499 | 3/1995 | Matyi et al. | 205/73 |

*Primary Examiner*—Kathryn L. Gorgos
*Assistant Examiner*—Kishor Mayekar
*Attorney, Agent, or Firm*—Oliff & Berridge, PLC

[57] ABSTRACT

A method of separating an electroformed metal substrate from a mandrel includes establishing a parting gap between the electroformed metal substrate and the mandrel, attaching the electroformed metal substrate at a parabolic end of the mandrel to a parting fixture, and introducing a fluid through the parting fixture into an opening of the mandrel to effect separation of the electroformed metal substrate from the mandrel. The parting fixture includes a parabolically shaped outer cup with a fluid inlet tube extending through the bottom thereof. The parting fixture also preferably includes an inner cup for containing the fluid introduced through the fluid inlet tube and a vacuum device to effect attachment of the electroformed metal substrate to the parting fixture.

18 Claims, 1 Drawing Sheet

PARTING FIXTURE FOR REMOVAL OF A SUBSTRATE FROM A MANDREL

BACKGROUND OF THE INVENTION

1. Field of the Invention

The invention relates to a parting fixture for use in a method of removing an electroformed article from a mandrel upon which the article is formed. The electroformed metal articles, preferably in the form of substrates, are useful as, for example, photoreceptor substrates.

2. Description of Related Art

The fabrication of metal articles by an electroforming process is well-known. For example, hollow metal tubes or belts are fabricated by electrodepositing a metal onto an elongated mandrel suspended in an electrolytic bath. Following removal from the bath and cooling, the resulting seamless electroformed metal articles are thereafter removed from the mandrel. Different techniques have been developed for forming and removing articles from electroforming mandrels depending upon the cross-disectional area of the electroformed article. Examples of these techniques are described, for example, in U.S. Pat. No. 4,501,646 to Herbert and 4,781,799 to Herbert, Jr. et al.

U.S. Pat. Nos. 3,927,463 to Dupree et al. and 3,950,839 to Dupree et al. disclose a method of forming an electroforming mandrel used in the production of endless seamless nickel xerographic belts. The mandrel includes a thin removable metal sleeve fitted over the core of the mandrel.

U.S. Pat. No. 4,067,783 to Okinaka et al. similarly discloses a process for making a mandrel used in the production of seamless nickel xerographic belts. The mandrel is formed through various pre-treatments, including nickel plating.

Methods for parting articles from a mandrel are also known. For example, U.S. Pat. No. 5,021,109 to Petropoulos et al. discloses that removal of a multilayered polymeric belt from a mandrel may be facilitated by any suitable means such as small driven elastomeric rollers in contact with the mandrel surface, vacuum cups or other vacuum means to grip the composite, gravity with vacuum assist and the like. The reference separately discloses that a fluid of air or liquid may be introduced between the substrate and mandrel prior to removing the substrate from the mandrel to reduce adhesion between the mandrel and the substrate. The reference also indicates that ultrasonic energy may be applied to the mandrel and/or substrate structure to facilitate removal. No parting fixture structures or ways to implement the removal methods are disclosed.

U.S. Pat. No. 5,064,509 to Melnyk et al. similarly discloses that a fluid of air or liquid may be introduced between a polymeric belt and a mandrel to reduce adhesion prior to removal. No parting fixtures or ways of implementing the fluid introduction are disclosed.

However, electroformed metal substrates used, for example, as photoreceptor substrates, are still predominantly removed from a mandrel using manual labor. The use of manual labor not only adds costs to the manufacturing process, it also has the disadvantage of possibly contaminating the electroformed metal surface with dirty gloves, marring the surface finish and scratching the surface, which render the substrate unsuitable for use as a photoreceptor substrate. Gripping the substrate also makes parting more difficult because it reduces the parting gap between the substrate and mandrel by causing the substrate to contact the mandrel. In addition, the use of manual parting reduces the life of the mandrel because of physical damage inflicted through the manual process.

One automatic parting scheme that has been proposed to replace manual parting is the use of an expandable bladder placed at the end of the mandrel. Following electroforming, the bladder is expanded to automatically separate the mandrel from the electroformed substrate. However, this automatic parting scheme has been found to suffer from many of the same disadvantages as those associated with manual parting.

Not only is it desired to find a satisfactory automatic parting method, it is also desired to find a method that requires no additional handling of the electroformed substrate following parting. In other words, a method having the advantage of not only removing the electroformed metal substrate from the mandrel, but also transporting the substrate to downstream operations without additional handling is also desired.

What is sought is an automatic parting method that removes an electroformed metal substrate from a mandrel and overcomes the above-discussed disadvantages associated with known methods of electroformed metal substrate removal.

SUMMARY OF THE INVENTION

It is an object of the present invention to provide a parting fixture and process for using the parting fixture which overcomes the above-discussed disadvantages.

It is another object of this invention to provide a parting fixture and process for using the parting fixture which is both simple and inexpensive.

It is still another object of this invention to provide an electroforming process for forming a hollow metal article upon a mandrel in which the mandrel is constructed in a manner to interact with the parting fixture and facilitate ready removal of the electroformed metal article from the mandrel.

These and other objects are achieved by providing a parting fixture comprising an outer cup and an inner cup that grip the electroformed metal substrate, the parting fixture also including a fluid inlet tube and preferably a vacuum. The fluid inlet tube fits into an opening at a parabolic shaped end of the mandrel.

In a parting method of the invention, a parting gap is established between the electroformed metal article and the mandrel, the electroformed metal article at the parabolic end of the mandrel is gripped by the parting fixture with or without a vacuum, fluid is introduced through the parting fixture into the opening at the parabolic end of the mandrel, and the electroformed metal article is separated from the mandrel. The fluid introduced through the parting fixture assists the process by entering the parting gap between the electroformed metal article and the mandrel to push the article and mandrel apart.

The separated electroformed metal article, still held by the parting fixture, may then be transported downstream for further steps in the manufacturing process without the need for any additional handling.

DETAILED DESCRIPTION OF PREFERRED EMBODIMENTS

Figure 1A:
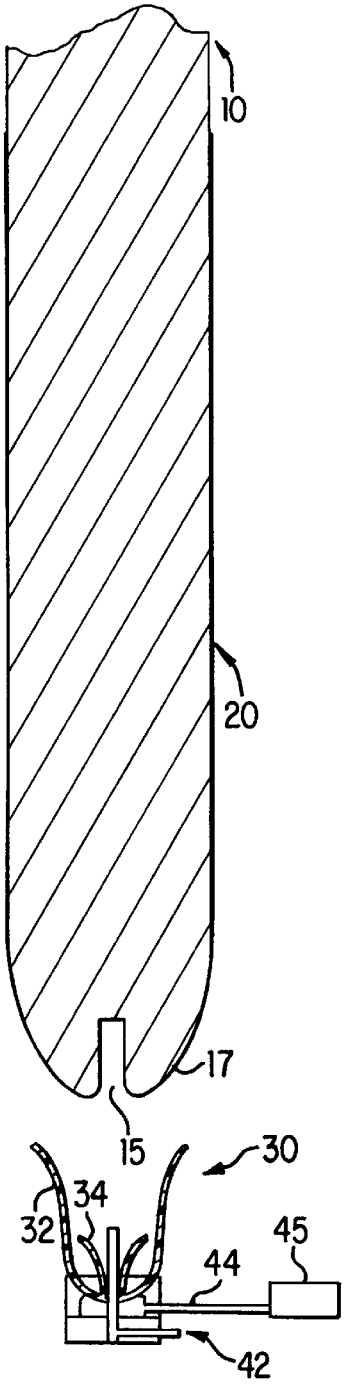
FIGS. 1A–1C illustrate a parting fixture and method according to the invention.

The invention will be described further with reference to FIGS. 1A–1C where appropriate.

The parting fixture of the invention preferably comprises an outer cup 32 having a generally parabolic shape. The outer cup preferably flares outwardly at the upper rim of the outer cup. Such a configuration permits the outer cup to suitably grip the electroformed hollow metal article 20 formed at a parabolic end 17 of the mandrel, while at the same time permitting the electroformed metal article to be removed easily from the outer cup as a result of the flared upper rim.

The parting fixture also includes a fluid inlet tube 42 that extends through a bottom portion of the outer cup and into the inner portion of the outer cup. As seen in FIG. 1B, when the electroformed metal article at the parabolic end of the mandrel is attached to the parting fixture, the fluid inlet tube extends into an opening 15 at the base of the parabolic end of the mandrel.

To accommodate the fluid inlet tube, the mandrel is formed with an opening 15 at the end that is to be attached to the parting fixture. The end of the mandrel around the opening, which preferably has a parabolic shape, is provided with a high depth to diameter ratio. As a result, during the electroforming process, which is described more fully below, metal will not be deposited into the opening. As such, it is not necessary to use any mask with the mandrel. Because a mask would require subsequent removal, the present method results in a lower cost process with fewer processing steps.

The outer cup of the parting fixture may be comprised of any suitable soft, flexible material capable of maintaining gripping attachment to an electroformed metal. Preferably, the outer cup is comprised of a soft to medium rubber or elastomer. As examples, the outer cup of the parting fixture may be comprised of rubbers and elastomers. The outer cup may also be comprised of additional ingredients such as release agents, for example.

The parting fixture also preferably includes an inner cup 34 inside of the outer cup 32. The inner cup is attached to the outer cup at the inside of the base portion of the outer cup around the fluid inlet tube. "Attached to" is intended here to include not only separately joined outer and inner cups, but also include outer and inner cups of a unitary structure.

As shown in FIG. 1A, the outer cup has a height extending beyond the height of the inner cup. The inner cup preferably curves outwardly toward the inner walls of the outer cup, but has a height insufficient to contact the inner wall of the outer cup, even when the parting fixture is attached to the electroformed metal article. By such a configuration, the inner cup can act as a seal for fluid injected into the opening of the mandrel during the parting process without interfering with the gripping attachment of the metal article by the outer cup.

Preferably, the inner cup of the parting fixture is formed of the same materials discussed above for the outer cup. However, the inner cup may also comprise any suitable flexible material capable of forming a good seal against an electroformed metal surface. For example, in addition to rubbers and elastomers, the inner cup may comprise a thermoplastic resin and the like.

In addition, the outer cup and inner cup may either or both be comprised of a flexible base material, including thermoplastic resins, elastomers or rubbers, coated or lined on an inner surface with a material appropriate for gripping and/or sealing as discussed above. Such surface coatings may comprise different thermoplastic resins, elastomers or rubbers from the base material.

In a most preferred embodiment, the parting fixture also includes a vacuum device 45 and conduit 44 to assist in the gripping attachment of the electroformed metal article by the parting fixture. Preferably, the vacuum device 45 is a vacuum pump or a venturi.

The outer cup of the parting fixture is provided with an opening to provide the vacuum device 45 access to the inner portions of the outer cup. When the parting fixture is to be attached to the electroformed metal article, the vacuum device is activated to evacuate the inner portions of the parting fixture and provide a stronger attachment between the parting fixture and the electroformed metal article.

Methods of electroforming a metal article upon the surface of the mandrel and subsequently separating the electroformed metal article from the mandrel will now be described in further detail.

The electroformed metal articles formed during the process are typically quite thin, on the order of 1 to 100 micrometers, for example. The articles that result are hollow, endless belts, also referred to herein as substrates. For applications in which the belts are used as photoreceptor substrates or ionographic receiver substrates, the substrates should preferably have a cylindrical shape. The shape of the substrate, as well as the inner circumference of the substrate, is determined by the shape of the mandrel. Thus, it is preferable to use a cylindrically shaped mandrel in forming metal belts for such applications.

Of course, for other applications, the mandrel may be formed into any suitable design. For example, the mandrel may have any other suitable configuration such as an oval, polygon, for example, a triangle, square, rectangle, hexagon, octagon and the like, a scalloped pattern and the like. Further, the mandrel may comprise connectable segment, for example as disclosed in U.S. Pat. No. 4,781,799, incorporated herein by reference. With such connectable segments, the end segments should have an end configured with a parabolic shape and have an opening at the base, as discussed above.

Electroformed metal substrates are typically quite small, on the order of 30, 60 and 84 millimeters in thickness diameter. To produce such thin substrates, it is necessary to form the substrates by electroforming. Preferably, the substrates comprise thin layers of electroformed metal.

Any suitable metal capable of being deposited by electroforming may be used in the process of this invention. Preferably, the electroformed metal has a coefficient of expansion of between about $6\times10^{-6}$ in/in/° F. and about $10\times10^{-6}$ in/in/° F. and a ductility of at least about 8 percent elongation. Typical metals that may be electroformed include, nickel, copper, cobalt, iron, gold, silver, platinum, lead, and the like, and alloys thereof. Nickel is the most preferred metal for use in forming the electroformed metal articles, particularly for applications in which an article will be used as a photoreceptor or ionographic receiver substrate.

The mandrel employed to form the elongated electroformed articles having a small cross-sectional area should normally be solid and of large mass or, in a less preferred embodiment, hollow with means to heat the interior to prevent cooling of the mandrel while the deposited coating is cooled. Thus, the mandrel has a high heat capacity, preferably in the range of from about 3 to about 4 times the specific heat of the corresponding electroformed article material. This determines the relative amount of heat energy contained in the electroformed article compared to that in the mandrel. Further, the mandrel should exhibit low thermal conductivity to maximize the difference in temperature (Delta T) between the electroformed article and the mandrel during rapid cooling of the electroformed article to prevent any significant cooling and contraction of the mandrel. In addition, a large difference in temperature between the temperature of the cooling bath and the temperature of the electroformed article and mandrel maximizes the permanent deformation due to the stress-strain hysteresis effect. A high thermal coefficient of expansion is also desirable in a mandrel to optimize permanent deformation due to the stress-strain hysteresis effect. Although an aluminum mandrel is characterized by a high thermal coefficient of expansion, it exhibits high thermal conductivity and low heat capacity, which are less effective for optimum permanent deformation due to the stress-strain hysteresis effect.

Suitable mandrels include stainless steel, iron plated with chromium or nickel, nickel, titanium, aluminum plated with chromium or nickel, titanium palladium alloys, Inconel 600, Invar and the like. The outer surface of the mandrel should be passive, i.e. abhesive, relative to the metal that is electroformed to prevent adhesion during electroforming.

In the method of separating an electroformed metal article from a mandrel, it is necessary to establish a parting gap between the electroformed metal article and the mandrel. The parting gap will permit fluid introduced through the fluid inlet tube of the parting fixture to infiltrate between the electroformed metal article and the mandrel, and thereby effect separation.

An adequate parting gap may be obtained even for electroformed articles having a small diameter or small cross-sectional area by controlling the stress-strain hysteresis characteristics of the electroformed article as discussed in, for example, U.S. Pat. No. 4,501,646 and U.S. Pat. No. 4,781,799, the entire disclosures of which are herein incorporated by reference. These patents also discuss suitable methods of electroforming a metal article or substrate, and these teachings are also incorporated herein by reference.

Sufficient hysteresis alone may be utilized to achieve an adequate parting gap to remove an electroformed article from a mandrel having a diameter of about 1.5 inches (3.8 cm) in the absence of any assistance from internal stress characteristics of the electroformed article or from any difference in thermal coefficients of expansion of the electroformed article and mandrel. The internal stress of an electroformed article includes tensial stress and the compressive stress. In tensial stress, the material has a propensity to become smaller than its current size. This is believed to be due to the existence of many voids in the metal lattice of the electroformed deposit with a tendency of the deposited material to contract to fill the voids. However, if there are many extra atoms in the metal lattice instead of voids, such as metal atoms or foreign materials, there is a tendency for the electroformed material to expand and occupy a larger space.

Stress-strain hysteresis is defined as the stretched (deformed) length of a material in inches minus the original length in inches divided by the original length in inches. The stress-strain hysteresis characteristics of the electroformed articles having a small diameter or small cross-sectional area may be maximized at, for example, about 0.00015 in/in (0.00015 cm/cm) or more.

The hysteresis characteristics of a given electroformed material may be controlled by adjusting the electroforming process conditions and the composition of the electroforming bath. Control involves adjusting the pH, metal component concentration, bath temperature, speed of core mandrel rotation, and the like. With each adjustment, a hysteresis stress strain curve is plotted for the product prepared with a given bath composition and the electroforming process conditions. Alterations are then again made to the electroforming process conditions and/or the composition of the electroforming bath until the hysteresis of the stress-strain curve is maximized.

When electroforming nickel articles or substrates having a small diameter or small cross-sectional area, the pH of the bath should be between, for example, about 3.75 and about 3.95, with optimum hysteresis characteristics being achieved at a pH of about 3.85. The relationship of nickel bath pH control to hysteresis may be determined, for example, by cutting rectangular samples from electroformed nickel articles prepared on 1 inch (2.54 cm) diameter stainless steel (304) mandrels having a length of about 24 inches (61 cm) in different electroforming baths maintained at 140° F. (60° C.) and nickel concentration of 11.5 oz/gal (86 g/l) but held at different pH values and plotting these data against the pH value of the bath in which each electroformed nickel article was made. A parting temperature of about 40° F. (4° C.) was employed. In order to remove an electroformed article from a core mandrel having a cross-sectional area of less than about 1.8 square inches (11.6 $cm^2$) and an overall length to cross-sectional area ratio greater than about 0.6, the stress-strain hysteresis is preferably, for example, at least about 0.00015 in/in (0.00015 cm/cm).

A preferred concentration of nickel for electroforming nickel articles having a cross-sectional area of less than about 1.8 square inches (11.6 $cm^2$) and an overall length to mandrel cross-sectional area ratio greater than about 0.6, is preferably between, for example, about 11 oz/gal (83 g/l) and about 12 oz/gal (90 g/l), with optimum being about 11.5 oz/gal (86 g/l).

To minimize surface flaws such as pitting, the surface tension of the plating solution is preferably adjusted to, for example, between about 33 dynes per square centimeter to about 37 dynes per square centimeter. The surface tension of the solution may be maintained within this range by adding an anionic surfactant such as sodium lauryl sulfate, sodium alcohol sulfate (Duponol 80, available from E.I. duPont de Nemours and Co., Inc.), sodium hydrocarbon sulfonate (Petrowet R, available from E.I. duPont de Nemours and Co., Inc.) and the like. Up to about 0.014 oz/gal (0.1 g/l) of an anionic surfactant may be added to the electroforming solution. The surface tension in dynes per centimeter is generally about the same as that described in U.S. Pat. No. 3,844,906. The concentration of sodium lauryl sulfate is sufficient to maintain the surface tension at about 33 dynes per centimeter to about 37 dynes per centimeter.

Saccharine is a stress reliever. However, in a concentration of more than about 2 grams per liter, it causes nickel oxide to form as a green powder rather than as a nickel deposit on core mandrels. At concentrations of about 1 gram per liter the deposited nickel layer will often become so compressively stressed that the stress will be relieved during deposition causing the deposit to be permanently wrinkled. Consequently, one cannot depend on adding large quantities of saccharine or other stress reducers to an electroforming bath to produce the desired parting gap. Additionally, saccharine renders the deposit brittle, thus limiting its use.

A preferred current density is between about 300 amps per square foot (0.325 amps/$cm^2$) and about 400 amps per square foot (0.43 amps/$cm^2$). Higher current densities may be achieved by increasing the electrolyte flow, mandrel rotational speed, electrolyte agitation, and cooling. Current densities as high as 900 amps per square foot (0.968 amps/$cm^2$) have been demonstrated.

Parting conditions are also optimized by cooling the outer surface of the electroformed substrate rapidly to cool the entire deposited coatings prior to any significant cooling and contracting of the mandrel permanently deform the electroformed substrate. The rate of cooling should be sufficient to impart a stress in the electroformed articles of between about 40,000 psi (2,818 kg/cm$^2$) and about 80,000 psi (5,636 kg/cm$^2$) to permanently deform the electroformed articles and to render the length of the inner perimeter of the electroformed articles incapable of contracting to less than 0.04 percent greater than the length of the outer perimeter of the mandrel after the mandrel is cooled.

The difference in temperature between the electroformed coating and the outer cooling medium must be sufficiently less than the difference in temperature between the cooling medium and the temperature of the mandrel during the stretching phase of the process to achieve sufficient permanent deformation of each electroformed article. Nickel has a low specific heat capacity and a high thermal conductivity. Thus, when an assembly of an electroformed cylindrical nickel substrate on a solid stainless steel core mandrel, such as 304 stainless steel, having a diameter of about 1 inch (2.54 cm) originally at a temperature of 140° F. (60° C.) is cooled by immersion in a liquid bath at a temperature of about 40° F. (4° C.), the temperature of the electroformed article may be dropped to 40° F. (4° C.) in less than 1 second whereas the mandrel itself requires 10 seconds to reach 40° F. (4° C.) after immersion.

The electroforming process of this invention for forming electroformed articles may be conducted in any suitable electroforming device. For example, a solid cylindrically shaped mandrel may be suspended vertically in an electroplating tank. The mandrel is constructed of electrically conductive material that is compatible with the metal plating solution. For example, the mandrel may be made of stainless steel. The top edge of the mandrel may be masked off with a suitable nonconductive material, such as wax, to prevent deposition.

The electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source.

In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank and immersed in a cold water bath. The temperature of the cold water bath is preferably between, for example, about 80° F. (27° C.) and about 33° F. (0.5° ). When the mandrel is immersed in the cold water bath, the deposited metal is cooled prior to any significant cooling and contracting of the mandrel to impart an internal stress of between about 40,000 psi (2,818 kg/cm$^2$) and about 80,000 psi (5,636 kg/cm$^2$) to the deposited metal. Since the metal cannot contract and is selected to have a stress-strain hysteresis of at least about 0.00015 in/in (0.00015 cm/cm),it is permanently deformed so that after the mandrel is cooled and contracted, the deposited metal substrate may be removed from the mandrel. The deposited metal substrate does not adhere to the mandrel since the mandrel is selected from a passive material. Consequently, as the mandrel shrinks after permanent deformation of the deposited metal, the deposited metal substrate may be readily removed from the mandrel with the use of the parting fixture.

A suitable electroforming apparatus for carrying out an electroforming process is described, for example, in U.S. Pat. No. 3,954,568. The entire disclosure of this U.S. Patent is incorporated herein by reference.

A typical electrolytic cell for depositing metals may comprise a tank containing a rotary drive means including a mandrel supporting drive hub centrally mounted thereon. For purposes of the following description, the metal to be deposited is nickel. The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Non-sulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

Electroforming may be carried out in a nickel sulfamate solution treating loop. For example, articles can be electroformed by preheating a solid electrically conductive mandrel at a preheating station. Preheating can be effected by contacting the mandrel with a nickel sulfamate solution at about 140° F. (60° C.) for a sufficient period of time to bring the solid mandrel to about 140° F. (60° C.). Preheating in this manner allows the mandrel to expand to the dimensions desired in the electroforming zone and enables the electroforming operation to begin as soon as the mandrel is placed in the electroforming zone. Thereafter, the mandrel is transported from the preheating station to an electroforming zone. The electroforming zone may comprise at least one cell containing an upstanding electrically conductive rotatable spindle which is centrally located within the cell and a concentrically located container spaced therefrom which contains donor metallic nickel. The cell is filled with nickel sulfamate electroforming solution. The mandrel is positioned on the upstanding electrically conductive rotatable spindle and is rotated thereon. A DC potential is applied between the rotating mandrel cathode and the donor metallic nickel anode for a sufficient period of time to effect electrodeposition of nickel on the mandrel to a predetermined thickness.

Upon completion of the electroforming process, the mandrel and the nickel articles formed thereon are transferred to a nickel sulfamate solution recovery zone. Within this zone, a major portion of the electroforming solution dragged out of the electroforming cell is recovered from the articles and mandrel. Thereafter, the electroformed articles bearing mandrel is transferred to a cooling zone containing water maintained at about 40° F. (4° C.) to 80° F. (27° C.) or cooler for cooling the mandrel and the electroformed articles whereby the electroformed articles are cooled prior to any significant cooling and contracting of the mandrel whereby a stress of between about 40,000 psi (2,818 kg/cm$^2$) and about 80,000 psi (5,636 kg/cm$^2$) is imparted to each cooled electroformed article to permanently deform each electroformed article and to render the length of the inner perimeter of each electroformed article incapable of contracting to less than about 0.4 percent greater than the length of the outer perimeter of the mandrel after the core mandrel is cooled and contracted. Cooling is then continued to cool and contract the solid mandrel.

After cooling, the mandrel and electroformed articles are passed to a parting fixture and then to a cleaning station at which the electroformed articles are removed from the mandrel, sprayed with water and subsequently passed to a dryer. The mandrel is sprayed with water and checked for cleanliness before being recycled to the preheat station to commence another electroforming cycle.

Very high current densities are employed with a nickel sulfamate electroforming solution. Generally, the current densities range from about 150 amps per square foot (0.16 amps/cm$^2$) to about 500 amps per square foot (0.53 amps/cm$^2$), with a preferred current density of about 300 amps per square foot (0.32 amps/cm$^2$). Current concentrations generally range from about 5 amps per gallon (1.2 amps/l) to about 20 amps per gallon (5 amps/l).

At the high current density and high current concentration, a great deal of heat is generated in the metal or metal alloy electroforming solution within the electroforming cell for small sectional area hollow articles. This heat must be removed in order to maintain the solution temperature within the cell in the preferred range of, for example, about 135° F. (57° C.) to about 145° F. (63° C.), and preferably at about 140° F. (60° C.).

Because of the significant effects of both temperature and solution composition on the final small cross-sectional area product as discussed herein, the electroforming solution is preferably maintained in a constant state of agitation thereby substantially precluding localized hot or cold spots, stratification and inhomogeneity in the composition. Moreover, constant agitation continuously exposes the mandrel to fresh solution and, in so doing, reduces the thickness of the cathode film, thus increasing the rate of diffusion through the film and thus enhancing nickel deposition. Agitation is maintained by continuous rotation of the mandrel and by impingement of the solution of the mandrel and cell walls as the solution is circulated through the system. Generally, the solution flow rate across the mandrel surfaces can range from about 4 linear feet per second (122 linear cm/sec) to about 10 linear feet per second (305 linear cm/sec). For example, at a current density of about 300 amps per square foot with a desired solution temperature range within the cell of about 138° F. (59° C.) to about 142° F. (61° C.), a flow rate of about 20 gal/min (80l/min) of solution has been found sufficient to effect proper temperature control. The combined effect of mandrel rotation and solution impingement assures uniformity of composition and temperature of the electroforming solution within the electroforming cell.

For continuous, stable operation to achieve the preferred stress-strain hysteresis of at least about 0.00015 in/in (0.00015 cm/cm), the composition of the aqueous nickel sulfamate solution within the electroforming zone is preferably as follows, for example:

Total nickel: 11 to 12 oz/gal (82.5–90 g/l)

$H_3BO_3$: 4 to 5 oz/gal (30–37.5 g/l)

pH: 3.75 to 3.95

Surface Tension: 33 to 37 dynes/cm$^2$.

A metal halide, generally a nickel halide such as nickel chloride, nickel bromide, or nickel fluoride and preferably, nickel chloride, are included in the nickel sulfamate electroforming solution to avoid anode polarization. Anode polarization is evidenced by gradually decreasing pH during operation.

The pH of the nickel electroforming solution is preferably between about 3.75 and about 3.95. At a pH of greater than about 4.1, surface flaws such as gas pitting may increase. Also, internal stress increases and may interfere with parting of the electroformed belt from the mandrel. At a pH of less than about 3.5, the metallic surface of the mandrel may become activated, especially when chromium plated mandrels are employed, thereby causing the metal electroformed to adhere to the chromium plating. Low pH also results in lower tensile strength. The pH level may be maintained by the addition of an acid such as sulfamic acid, when necessary. Control of the pH range may also be assisted by the addition of a buffering agent such as boric acid within a range of about 4 oz/gal (30 g/l) to about 5 oz/gal (37.5 g/l).

In order to maintain a continuous steady state operation, the nickel sulfamate electroforming solution can be continuously circulated through a closed solution treating loop. This loop may comprise a series of processing stations which maintain a steady state composition of the solution, regulate the temperature of the solution and remove any impurities therefrom.

The electroforming cell may contain, for example, one wall thereof which is shorter than the others and acts as a weir over which the electroforming solution continuously overflows to a trough as recirculating solution is continuously pumped into the cell via a solution distributor manifold or sparger along the bottom of the cell. The solution flows from the electroforming cell via the trough to an electropurification zone and a solution sump. The solution is then pumped to a filtration zone and to a heat exchange station and is then recycled in purified condition at a desired temperature and composition to the electroplating cell whereupon that mixture with the solution contained therein in a steady state condition set forth above are maintained on a continuous and stable basis.

The electrolytic zone removes the dissolved nobel metallic impurities from the nickel sulfamate solution prior to filtering. A metal plate of steel, or preferably stainless steel, can be mounted in the electrolytic zone to function as the cathode electrode. Anodes can be provided by a plurality of anode baskets which comprise tubular shaped metallic bodies, preferably titanium, each having a fabric anode bag. A DC potential may be applied between the cathodes and the anodes of the purification station from a DC source. The electropurification zone can include a wall which extends coextensively with the wall of the solution sump zone and functions as a weir.

The solution can be replenished by the automatic addition of deionized water from a suitable source and/or by recycling solution from a nickel rinse zone. A pH meter can be employed for sensing the pH of the solution and for effecting the addition of an acid such as sulfamic acid when necessary to maintain essentially constant pH. The stress reducing agents and surfactant can be continuously added by suitable pumps.

The electroforming solution which flows from the electroforming cell is raised in temperature due to the flow of relatively large currents therein and accompanying generation of heat in the electroforming cell. Means may be provided at a heat exchanging station for cooling the electroforming solution to a lower temperature. The heat exchanger may be of any conventional design which receives a coolant such as chilled water from a cooling or refrigerating system. The electroplating solution which is cooled in the heat exchanger means can be successively pumped to a second heat exchanger which can increase the temperature of the cool solution to within relatively close limits of the desired temperature. The second heat exchanger can be heated, for example, by steam derived from a steam generator. The first cooling heat exchanger can, for example, cool the relatively warm solution from a temperature of about 145° F. (63° C.) or above to a temperature of about 135° F. (57° C.). A second warming heat exchange can heat the solution to a temperature of 140° F. (60° C.). The efflux from the heat exchange station can then be pumped to the electroforming cell.

By manipulating the bath parameters such as the addition of enhancers, altering pH, changing the temperatures, adjusting the cation concentration of the electroforming bath, or regulating current density, one may alter the stress-strain hysteresis of the electroformed article. Thus, the conditions are experimentally altered until a deposited electroformed article is characterized by a desired stress-strain hysteresis of, for example, at least about 0.00015 in/in (0.00015 cm/cm). For example, when electroforming nickel, the relative quantity of enhancers such as saccharine, methylbenzene sulfonamide, the pH, the bath temperature, the nickel cation concentration, and the current density may be adjusted to achieve a preferred stress-strain hysteresis of at least about 0.00015 in/in (0.00015 cm/cm). Current density affects the pH and the nickel concentration. Thus, if the current density increases, the nickel is unable to reach the surfaces of the mandrel at a sufficient rate and the ½ cell voltage increases and hydrogen ions deposit, thereby increasing the hydroxyl ions remaining in the bath and increasing the pH. Moreover, increasing the current density also increases the bath temperature.

Following electroforming of the metal article, including establishing a satisfactory parting gap between the electroformed metal article and the mandrel, the electroformed metal article is then separated from the mandrel. This is achieved by attaching the electroformed metal article at the parabolic end of the mandrel to the parting fixture. As discussed above, the attachment may be effected with the use of a vacuum device if the parting fixture is equipped with such a vacuum device. Otherwise, the attachment is achieved from the gripping force created in the outer cup of the parting fixture as it is flexed outwardly when brought into contact with the parabolic end of the mandrel, as shown for example in FIG. 1B.

Figure 1B:
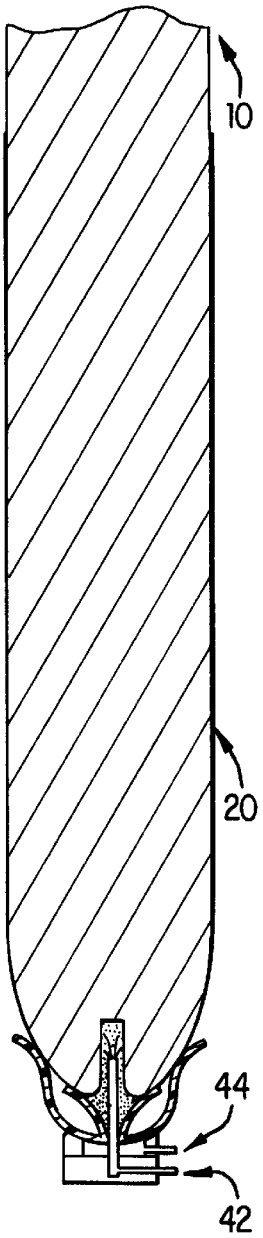

Also as shown in FIG. 1B following attachment, the fluid inlet tube of the parting fixture extends into the opening 15 of the mandrel 10. A fluid is then introduced through the fluid inlet tube into the opening of the mandrel. The fluid will fill the inner portion of the parting fixture and penetrate the parting gap between the electroformed metal article and the mandrel. If the parting fixture is further equipped with an inner cup, the inner cup will act as a seal to contain the fluid flow within the inner cup portion of the parting fixture.

The fluid used to effect separation of the electroformed metal article from the mandrel may be of any suitable type, including gases and liquids. Preferably, the fluid is either air or water. More preferably, the fluid is air or water mixed with a wetting solution, which preferably is, for example, sodium lauryl sulfate or Petrowet R (sodium hydrocarbon sulfonate available from E. I. duPont de Nemours and Company) and the like.

To effect a good, clean separation between the electroformed metal article and the mandrel, the fluid should be introduced into the opening of the mandrel at a reasonable flow rate. The flow rate may differ depending on the size of the mandrel, but generally is within the range of about 0.001 to 2 liters per minute.

Figure 1C:
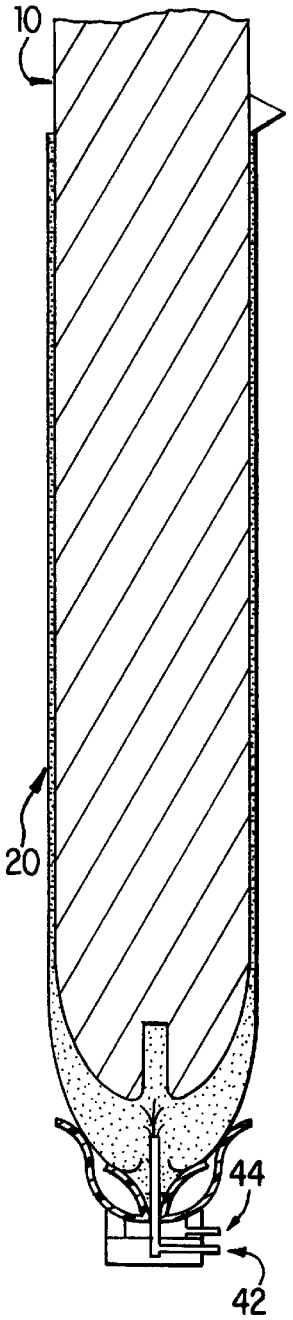

During introduction of the fluid, the mandrel will be separated from the electroformed metal article as shown in FIG. 1C. The electroformed metal article continues to be attached to the parting fixture throughout the separation process. As such, following separation, the parting fixture can be used to transport the electroformed metal article to downstream operations such as a cleaning station for cleaning the electroformed metal article. This eliminates the need for any additional handling and consequently eliminates the risk that the electroformed metal article will be contaminated or damaged during manual handling. This is particularly important where the article is a substrate for use in photoreceptors.

To assist in separation of the electroformed metal article from the mandrel during fluid introduction, it may be desired to pull the electroformed metal article away from the mandrel along an axis parallel to the length of the mandrel. This may be effected with use of the parting fixture. The rate of pulling the parting fixture and attached electroformed metal article away from the mandrel is preferably roughly equal to the rate at which the gap between the mandrel and the electroformed metal article is filled with fluid.

In addition to being able to pull the electroformed metal article away from the mandrel, the parting fixture preferably is also able to rotate about an axis parallel to the length of the mandrel (i.e., an axis parallel to the fluid inlet tube of the parting fixture). Such rotation may be useful in separating the lengthwise sides of the electroformed metal article from the mandrel.

Although the invention has been described with reference to specific preferred embodiments, those skilled in the art will recognize that variations and modifications may be made which are within the spirit of the invention and within the scope of the claims.

What is claimed is:

1. A parting fixture comprising an outer cup, an inner cup, a fluid inlet tube, wherein the outer cup has a parabolic shape for attaching to a parabolic end of an electroformed metal article and extends in height beyond a height of the inner cup, the outer cup is entirely radially external to the inner cup, the fluid inlet tube extends through a base portion of and into an inner portion of the outer cup and the inner cup, the inner cup is attached to the outer cup at an inner base portion of the outer cup and around the fluid inlet tube and is adapted to retain fluid introduced through the fluid inlet tube, and vacuum device means for evacuating the inner portion of the outer cup outside of the inner cup to attach the outer cup to the parabolic end of the electroformed metal article.

2. The parting fixture according to claim 1, wherein the inner cup curves outwardly toward an inner wall of the outer cup, but has a height insufficient to contact the inner wall of the outer cup.

3. The parting fixture according to claim 1, wherein the outer cup and inner cup comprise a rubber or elastomer.

4. The parting fixture according to claim 1, wherein the vacuum device is a vacuum pump or venturi.

5. The parting fixture according to claim 1, wherein the parting fixture is rotatable about an axis parallel to the fluid inlet tube.

6. The parting fixture according to claim 1, wherein the outer cup comprises a rim which flares outwardly.

7. A method of separating an electroformed metal article from a mandrel comprising:

establishing a parting gap between the electroformed metal article and the mandrel;

attaching the electroformed metal article at an end where the electroformed metal article conforms to a parabolic end of the mandrel to a parting fixture comprising an outer cup, an inner cup and a fluid inlet tube, wherein the outer cup has a parabolic shape for attaching to the electroformed metal article and extends in height beyond a height of the inner cup, the fluid inlet tube extends through a base portion of and into an inner portion of the outer cup and the inner cup, and the inner cup is attached to the outer cup at an inner base portion of the outer cup and around the fluid inlet tube and retains fluid introduced through the fluid inlet tube, and wherein the parabolic end of the mandrel has an opening accommodating the fluid inlet tube of the parting fixture; and introducing a fluid through the fluid inlet tube into the opening of the mandrel to separate the electroformed metal article from the mandrel.

8. A method of separating an electroformed metal article from a mandrel comprising:

establishing a parting gap between the electroformed metal article and the mandrel;

attaching the electroformed metal article at an end where the electroformed metal article conforms to a parabolic end of the mandrel to a parting fixture with a vacuum, the parabolic end of the mandrel further having an opening accommodating a fluid inlet tube of the parting fixture; and introducing a fluid through the fluid inlet tube into the opening of the mandrel to separate the electroformed metal article from the mandrel.

9. The method according to claim 8, wherein the parting gap is established through control of stress strain hysteresis characteristics of the electroformed metal article.

10. The method according to claim 9, wherein the parting fixture comprises an outer cup for gripping the electroformed metal substrate and an inner cup to contain introduced fluid.

11. The method according to claim 10, wherein the outer cup and inner cup comprise rubber or elastomer.

12. The method according to claim 9, wherein the introduced fluid is air or water, optionally containing a wetting solution.

13. The method according to claim 12, wherein the wetting solution is sodium lauryl sulfate or sodium hydrocarbon sulfonate.

14. The method according to claim 9, wherein the method further comprises moving the parting fixture and attached electroformed metal article away from the mandrel as the fluid is introduced.

15. The method according to claim 9, further comprising rotating the parting fixture about an axis parallel to a length of the mandrel to assist in separation of the electroformed metal article from the mandrel.

16. A method of forming an electroformed metal article comprising:

placing a mandrel having a parabolic end with an opening at the parabolic end in an electroforming bath;

depositing a layer of metal onto the mandrel from the electroforming bath to form a metal coated mandrel;

establishing a parting gap between the metal coating and the mandrel;

removing the metal coated mandrel from the electroforming bath;

attaching the metal coated mandrel at an end where the metal coating conforms to the parabolic end of the mandrel to a parting fixture with a vacuum, the opening at the parabolic end of the mandrel accommodating a fluid inlet tube of the parting fixture; and introducing a fluid through the fluid inlet tube into the opening of the mandrel to separate the metal coating from the mandrel to obtain the electroformed metal article.

17. The method according to claim 16, wherein the electroformed metal article comprises nickel, copper, cobalt, iron, gold, silver, platinum, lead, or alloys thereof.

18. The method according to claim 16, wherein the electroformed metal article is a nickel photoreceptor substrate.

* * * * *